US008524330B2

(12) United States Patent
Fan et al.

(10) Patent No.: US 8,524,330 B2
(45) Date of Patent: Sep. 3, 2013

(54) METHOD AND APPARATUS FOR PAINT CURING

(75) Inventors: Hua-Tzu Fan, Troy, MI (US); Hong-Hsiang Kuo, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 243 days.

(21) Appl. No.: 12/705,685

(22) Filed: Feb. 15, 2010

(65) Prior Publication Data

US 2010/0227082 A1 Sep. 9, 2010

Related U.S. Application Data

(60) Provisional application No. 61/157,928, filed on Mar. 6, 2009.

(51) Int. Cl.
*B05D 3/06* (2006.01)
*B05C 9/14* (2006.01)

(52) U.S. Cl.
USPC ..... 427/542; 427/553; 427/557

(58) Field of Classification Search
None
See application file for complete search history.

(56) References Cited

U.S. PATENT DOCUMENTS

| | | | | |
|---|---|---|---|---|
| 4,907,533 | A | 3/1990 | Nelson et al. | |
| 4,908,231 | A * | 3/1990 | Nelson et al. | 427/542 |
| 5,319,861 | A | 6/1994 | Tate | |
| 5,456,023 | A | 10/1995 | Farnan | |
| 6,291,027 | B1 * | 9/2001 | Emch | 427/542 |
| 6,889,446 | B2 | 5/2005 | Schneider | |
| 6,893,687 | B2 | 5/2005 | Maurus | |
| 6,895,689 | B2 | 5/2005 | Ueno | |
| 2003/0201182 | A1 * | 10/2003 | Nakamura et al. | 204/484 |
| 2004/0076756 | A1 | 4/2004 | Fey et al. | |
| 2005/0069310 | A1 * | 3/2005 | Reichelt | 392/437 |
| 2005/0095364 | A1 | 5/2005 | Curcic et al. | |
| 2006/0001011 | A1 * | 1/2006 | Wilson et al. | 252/500 |
| 2006/0078672 | A1 * | 4/2006 | Merz et al. | 427/96.2 |
| 2007/0022624 | A1 | 2/2007 | Chu Yuk Man | |
| 2007/0062060 | A1 | 3/2007 | Swoboda | |
| 2007/0160851 | A1 * | 7/2007 | Barancyk et al. | 428/423.1 |
| 2007/0271812 | A1 | 11/2007 | Swoboda et al. | |
| 2008/0014368 | A1 | 1/2008 | Feyrer et al. | |
| 2008/0063807 | A1 | 3/2008 | DeRegge et al. | |

FOREIGN PATENT DOCUMENTS

| | | | |
|---|---|---|---|
| DE | 4336856 | A1 | 5/1995 |
| DE | 10055336 | A1 | 5/2002 |
| EP | 0639660 | B1 | 5/1997 |
| EP | 1744115 | A2 | 1/2007 |
| EP | 2071260 | A1 | 6/2009 |
| FR | 2695196 | A1 | 3/1994 |

(Continued)

OTHER PUBLICATIONS

Grande, Combined Infrared & Convection Heating, posted onlie Sep. 2001.*

(Continued)

*Primary Examiner* — Joseph Miller, Jr.

(57) ABSTRACT

A method for curing a paint coating applied to a workpiece includes applying radiant light energy to cure the paint coating on surfaces of the workpiece within a line of sight of a radiant light energy source, and applying ambient air to the workpiece to cure the paint coating on surfaces of the workpiece not within the line of sight of the radiant light energy source.

11 Claims, 3 Drawing Sheets

(56) References Cited

FOREIGN PATENT DOCUMENTS

| | | | |
|---|---|---|---|
| JP | 2000084464 | A | 3/2000 |
| JP | 2009168363 | A | 7/2009 |
| WO | WO-2005023437 | A2 | 3/2005 |

OTHER PUBLICATIONS

Dupont, ChromaSystem Non-Stop Process for Collision Repair, Oct. 2005, E-R4216 K-10609.

Southern Company Technology Applications Center, Induction sets speed record for powder paint curing, Technology Applicatations Center News Update, 2009.

Southern Company Technology Applications Center, Infrared booster doubles line speed, Technology Applicatations Center News Update, 2009.

Radtech, UV and EB Technology and the South Coast Air Quality Management District-A Users Guide, Jan. 2009.

* cited by examiner

METHOD AND APPARATUS FOR PAINT CURING

CROSS REFERENCE TO RELATED APPLICATIONS

This application claims the benefit of U.S. Provisional Application No. 61/157,928, filed on Mar. 6, 2009, which is incorporated herein by reference.

TECHNICAL FIELD

This disclosure is related to automotive paint application and automotive paint curing.

BACKGROUND

The statements in this section merely provide background information related to the present disclosure and may not constitute prior art.

During the assembly of an automobile, it is desirable to provide the automobile body a high quality finish. The quality of the finish improves the marketability of the automobile as well as protects the automobile body from elements.

The paint baking process during automobile assembly is a major energy consuming process in an automotive assembly paint shop. A typical topcoat oven used for paint baking has three major functions: (1) controlling volatile organic compound (VOC) emissions and solvent odors by driving out paint solvents or water; (2) achieving appearance quality where the top coat oven helps paint flow and level during film formation; and (3) providing durability by promoting cross-linking to cure the paint. However, topcoat ovens are large, ranging in size to about 470 feet long, thus increasing manufacturing costs and limiting space in the automotive assembly paint shop. Additionally, operation of a topcoat oven is associated with a high energy consumption rate per year. It is recognized that operation of topcoat ovens are second only to spray booths in the highest consumption of energy at the automobile paint shop. A typical automotive assembly paint shop utilizes two to three topcoat ovens.

SUMMARY

A method for curing a paint coating applied to a workpiece includes applying radiant light energy to cure the paint coating on surfaces of the workpiece within a line of sight of a radiant light energy source, and applying ambient air to the workpiece to cure paint coating on surfaces of the workpiece not within the line of sight of the radiant light energy source.

BRIEF DESCRIPTION OF THE DRAWINGS

One or more embodiments will now be described, by way of example, with reference to the accompanying drawings, in which.

DETAILED DESCRIPTION

Figure 1:
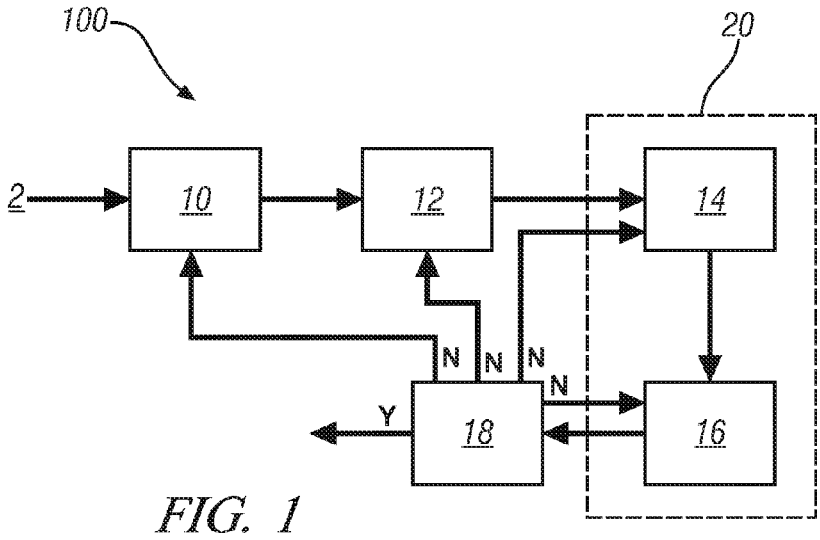
FIG. 1 schematically illustrates a paint application process in accordance with an exemplary embodiment of the present disclosure.

Referring now to the drawings, wherein the showings are for the purpose of illustrating certain exemplary embodiments only and not for the purpose of limiting the same, FIG. 1 schematically illustrates a paint application process 100 in accordance with an exemplary embodiment of the present disclosure. The exemplary paint application process 100 includes a coating station 10, a heat flash station 12, a curing process 20 and an inspection station 18. The curing process 20 includes a radiation cure station 14 and an ambient cure station 16. In operation, an unfinished workpiece 2 is presented to the coating station 10 where a fresh coat of paint is applied to the workpiece 2. Upon exiting the coating station 10, the painted workpiece 2 is first presented to the heat flash station 12 and then to the radiation cure station 14 and the ambient cure station 16 of curing process 20 to substantially cure the workpiece 2. Upon completion of the curing process 20, the substantially cured workpiece 2 is examined at the inspection station 18.

An exemplary coating station 10 includes a paint spray booth where a fresh coat of paint is applied to the workpiece 2. An exemplary workpiece 2 is an automobile wherein a fresh coat of paint is applied to interior and exterior surfaces of the automobile. However, the workpiece 2 is not limited to automobiles. The fresh coat of paint includes a paint material having a chemical composition enabling the paint coating to be cured by both efficient radiant light energy (i.e., the radiation cure station 14) and low bake systems (i.e., the ambient cure station 16). It is desirable that the paint coating be substantially resistant to scratches and chips, meet appearance and exposure standards and be adaptable to existing application processes (i.e., a spray booth).

Figure 2:
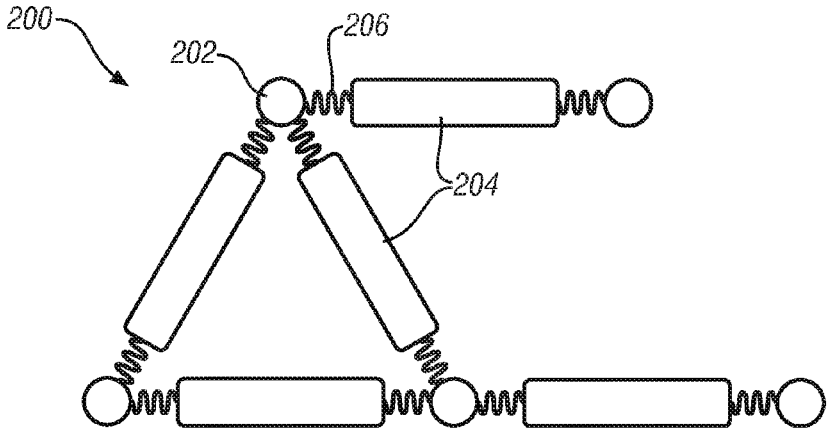
FIG. 2 schematically illustrates the chemical composition of a paint coating that can be cured by both efficient radiant light energy and low bake systems in accordance with the present disclosure.

Referring to FIG. 2, the chemical composition of an exemplary paint coating 200 is illustrated in accordance with an exemplary embodiment of the present disclosure. The paint coating 200 can be cured or hardened by both efficient radiant light energy (i.e., the radiation cure station 14) and low bake systems (i.e., the ambient cure station 16). Efficient radiant light energy can include ultraviolet light, near infrared (NIR) light, and conventional infrared light having short, medium and long wavelengths. Likewise, low bake systems can include ambient air at ambient temperature or can additionally blow warm or hot air to help facilitate the curing process and decrease tack free times. The paint coating 200 cross-links polymer segments 204 and silica segments 202, wherein each end of each polymer segment 204 is linked to a silica segment 202 utilizing a cross-linking material 206. The silica segments 202 are hard segments that provide scratch resistance, whereas the polymer segments 204 are soft and flexible segments that provide structural integrity while substantially preventing cracking during the curing process 20. It should be appreciated that the exemplary paint coating 200 not be limited to a chemical composition including the cross-linking of polymer and silica segments 204 and 202, respectively, but can include any chemical composition capable of being cured by both low bake systems and efficient radiation energy.

As mentioned above, after a fresh coat of paint is applied to the workpiece 2 at the coating station 10, the workpiece 2 is sent to the heat flash station 12. The heat flash station 12 includes a heated flash process to drive out solvents and water from the paint coating 200. Driving out solvents and water from the paint coating substantially reduces volatile organic compound (VOC) emissions and solvent odors from the paint coating 200 before curing at the radiation cure station 14 and the ambient cure station 16. Heated flash stations 12 are known in the art and will not be discussed in great detail herein.

As discussed above, topcoat ovens can be impractical due to size and cost constraints as well as the high energy consumption required for operating topcoat ovens. Many ideas and concepts have emerged to try to reduce or eliminate the need for paint ovens. These ideas generally fall into two categories: (1) low bake paint systems and (2) efficient radiant light energy cure systems. However, low bake paint systems and efficient radiant light energy cure systems used alone to cure a workpiece have shortfalls that prevent these systems and processes from replacing the topcoat oven. For example, low bake paint systems eliminate the need for a topcoat oven, however, exterior surfaces may attract airborne dust during a longer than desirable cure time and tack-free time. Radiant light energy cure systems allow for a fast cure time, however, reaching surfaces not in the line of sight of a radiant light energy source providing the radiant light energy requires the use of additional equipment or steps such as robotic arms and plasma chambers to reach surfaces not in the line of sight of the radiant light energy source. The exemplary curing process 20 illustrated in FIG. 1, and disclosed herein, utilizes the radiation cure station 14 (i.e., radiant light energy cure systems) and the ambient cure station 16 (i.e., low bake paint systems) to substantially cure the workpiece 2 without encompassing the drawbacks associated with only utilizing one of the of the systems discussed above.

Figure 3:
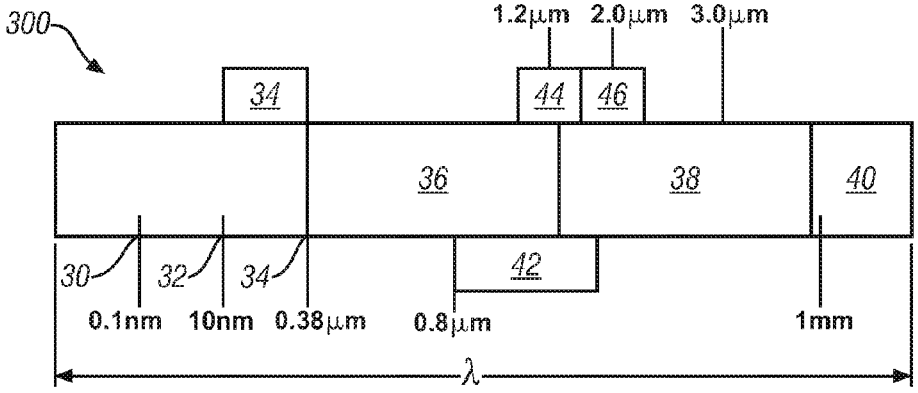
FIG. 3 illustrates a graphical depiction of an electromagnetic spectrum in order of increasing wavelength in accordance with the present disclosure.

Referring to FIG. 3, a graphical depiction of an electromagnetic spectrum 300 is illustrated in order of increasing wavelength (λ). The electromagnetic spectrum includes gamma rays 30, x-rays 32, ultraviolet radiation 34, visible light 36, infrared (IR) light 38 and radio waves 40. Ultraviolet light 34 includes a wavelength range between 10 nanometers and 0.38 microns. Near infrared (NIR) light 42 having a wavelength between 0.8 and 1.5 microns, overlaps portions of the visible light spectrum 36 and the IR light spectrum 38. Whereas the IR light spectrum 38 includes short and medium wavelengths 44 and 46, respectively, having wavelengths in the ranges of 1.2 and 2.0 microns, respectively. It is appreciated that short-wave IR light 44 overlaps into the visible light 36 spectrum at wavelengths between 1.0 and 1.2 microns.

Figure 4:
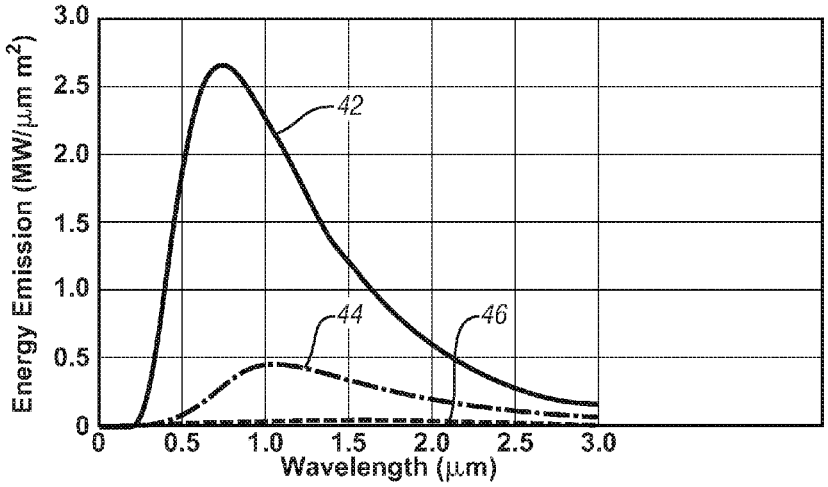
FIG. 4 illustrates a graphical depiction illustrating energy emissions of near infrared light, short wavelength infrared light and medium wavelength infrared light in accordance with the present disclosure.

Referring to FIG. 4, a graphical depiction illustrating energy emissions versus wavelength of NIR light 42, short-wave IR light 44 and medium-wave IR light 46 are illustrated in accordance with the present disclosure. The axis of ordinate denotes energy emissions ($MW/\mu m*m^2$) and the axis of abscissa denotes wavelength (μm). It is appreciated that NIR light 42 emits a higher amount of energy than short-wave IR light 44 and medium-wave IR light 46, and as will become apparent, the cure time is substantially shorter when utilizing NIR light 42 (or ultraviolet light 34) than it is for short- and medium-wave IR lights 44 and 46, respectively.

As will be discussed in greater detail herein, when radiant light energy (i.e., ultraviolet light 34 or NIR light 42) is applied to the surface of a paint coated (i.e., paint coating 200 shown in FIG. 2) workpiece 2, molecules within the paint are cross-linked during a chemical reaction and thereby achieve a hardened and substantially cured state. Radiant energy in the form of light (i.e., ultraviolet light 34 or NIR light 42) is particularly advantageous over topcoat ovens for curing a workpiece 2 surface because light energy provides for reduced energy consumption, while attaining very high gloss levels in the paint coating. The entire cross-linking of the paint coated (i.e., paint coating 200 shown in FIG. 2) workpiece 2 takes place in seconds when utilizing ultraviolet light 34 or NIR light 42, as opposed to minutes or hours in the thermal baking processes (i.e., topcoat oven). Cross-linking of the paint coated workpiece 2 takes place in minutes when utilizing shortwave IR 44 or medium-wave IR 46. In addition to reduced energy consumption, a lead benefit to the fast cure times produced by utilizing ultraviolet light energy 34 or NIR light energy 42, is the elimination or drastic reduction in airborne dust collection associated with slow tack free times of the painted workpiece 2 prior to being substantially cured.

Figure 5A:
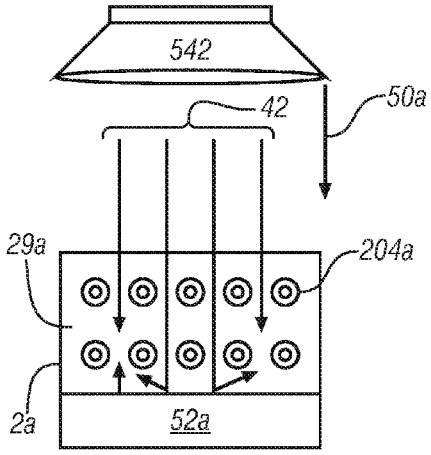
FIGS. 5*a*-5*d* illustrate pictorial diagrams of the chemical reactions during the curing of a workpiece utilizing various curing methods that include near infrared light, ultraviolet light, medium-wave infrared light and induction heating in accordance with the present disclosure; and, FIG. 6 illustrates a pictorial diagram of the chemical reaction during the curing of a workpiece utilizing ambient air at an ambient cure station in accordance with the present disclosure.
Figure 5B:
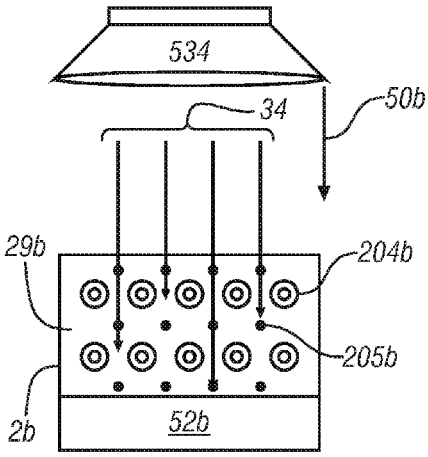
Figure 5C:
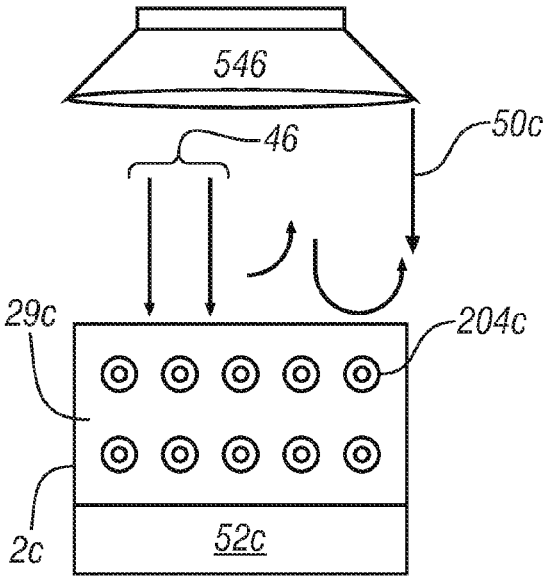
Figure 5D:
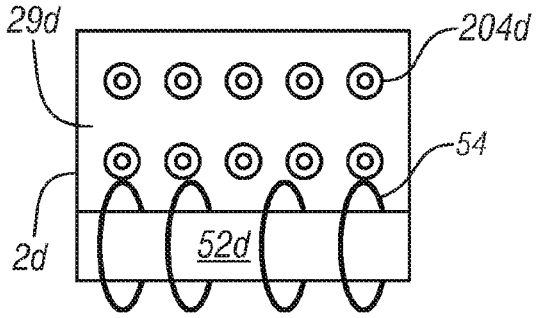

Referring to FIGS. 5*a*-5*d*, pictorial diagrams illustrating the chemical reactions during the curing of a workpiece 2*a*-2*d* utilizing various curing technology methods to cure the painted workpiece 2*a*-2*d* is shown, in accordance with the present disclosure. The curing technologies illustrated include NIR light 42 (FIG. 5*a*), ultraviolet light 34 (FIG. 5*b*), medium-wave IR light 46 (FIG. 5*c*) and induction heating (FIG. 5*d*).

Referring to FIG. 5*a*, NIR light 42 is projected from a NIR lamp 542 onto a paint coating 29*a* applied to a substrate surface 52*a* of a workpiece 2*a*. The paint coating 29*a* includes a plurality of paint molecules 204*a* disposed therein. The NIR lamp 542 projects NIR light 42 in a straight line to surfaces within the line of sight 50*a* of the NIR lamp 542. In an exemplary example, the NIR lamp 542 is shaped and sized to cure a workpiece 2 the size of a full automobile. In an alternative embodiment, a plurality of NIR lamps 542 can be utilized to cure the workpiece 2*a*, wherein each NIR lamp 542 can be configured to cure a portion of the workpiece 2*a*. As shown, radiation within the NIR light 42 is substantially absorbed by the paint coating 29*a*. The absorption of the NIR light 42 provides for fast and homogenous penetration of the NIR light 42 into the paint coating 29*a* to substantially cure a surface of the workpiece 2*a* in the line of sight 50*a* of the NIR lamp 542 without heating the substrate surface 52*a* as in the case of conventional infrared light radiation (i.e., medium-wave IR light 46 shown in FIG. 5*c*). As demonstrated by the high energy emissions in FIG. 4, the bandwidth of NIR light 42 can accomplish cure times at or near 70 seconds. It is appreciated that the paint coating 29*a* can include the chemical composition of the paint coating 200 (see FIG. 2) that can be cured or hardened by both NIR light 42 and low bake systems (i.e., the ambient cure station 16).

Referring to FIG. 5*b*, ultraviolet light 34 is projected from an ultraviolet lamp 534 onto a paint coating 29*b* applied to a substrate surface 52*b* of a workpiece 2*b*. The paint coating 29*b* includes a plurality of paint molecules 204*b* and a plurality of photo initiators 205*b* disposed therein. The ultraviolet lamp 534 projects ultraviolet light 34 in a straight line to surfaces within the line of sight 50*b* of the ultraviolet lamp 534. In an exemplary embodiment, the ultraviolet lamp 534 is shaped and sized to cure a workpiece 2*b* the size of a full automobile. In an alternative embodiment, a plurality of UV lamps 534 can be utilized to cure the workpiece 2*b*, wherein each UV lamp 534 can be configured to cure a portion of the workpiece 2*b*. When the paint coating 29*b* receives the ultraviolet light 34, the plurality of photo initiators 205*b* disposed within the paint coating 29*b* initiate a chemical chain reaction to promote cross-linking between the plurality of paint molecules 204*b* and thereby substantially cure a surface of the workpiece 2*b* in the line of site 50*b* of the UV lamp 534. This chemical chain reaction within the paint coating 29*b* can accomplish cure times in seconds. It is appreciated that the paint coating 29*b* can include the chemical composition of the paint coating 200 (see FIG. 2) that can be cured or hardened by both ultraviolet light 34 and low bake systems (i.e., the ambient cure station 16).

Referring to FIG. 5*c*, medium-wave IR light 46 is projected from an IR lamp 546 onto a paint coating 29*c* applied to a substrate surface 52*c* of a workpiece 2*c*. The paint coating 29*c* includes a plurality of paint molecules 204*c* disposed therein. The IR lamp 546 projects the medium-wave IR light 46 in a straight line to surfaces within the line of sight 50*c* of the IR lamp 546. In an exemplary embodiment, the IR lamp 546 is shaped and sized to cure a workpiece the size of a full automobile. In an alternative embodiment, a plurality of IR lamps 546 can be utilized to cure the workpiece 2*c*, wherein each IR lamp 546 can be configured to cure a portion of the workpiece 2*c*. Additionally, the substrate surface 52*c* is heated via conduction and only the top surface of the paint coating 29*c* is heated by the medium-wave IR light 46. Heating the top surface of the paint coating 29*c* and the substrate surface 52*c* via conduction can accomplish cure times in the paint coating 29*c* at or near 25 minutes. It is appreciated that the paint coating 29*c* can include the chemical composition of the paint coating 200 (see FIG. 2) that can be cured or hardened by both medium-wave IR light 46 and low bake systems (i.e., the ambient cure station 16).

NIR light 42 and ultraviolet light 34 are preferred methods of curing a surface within the line of sight of the radiant light energy source (i.e., lamps 542 or 534) due to decreased cure and tack free times compared to medium-wave IR light 46.

Referring to FIG. 5*d*, induction heating is applied to cure a paint coating 29*d* applied to a metallic substrate surface 52*d* of a workpiece 2*d*. The paint coating 29*d* includes a plurality of paint molecules 204*d* disposed therein. The substrate surface 52*d* is electromagnetically heated by a plurality of induction coils 54 around the substrate surface 52*d*, wherein the heat is absorbed by the paint coating 29*d* to substantially cure the paint coating 29*d*. The workpiece 2*d* can be substantially cured in seconds. In an example, induction heating can be utilized to substantially cure a paint coating applied to a roll-bar for application on a vehicle, wherein the roll-bar is electromagnetically heated by induction coils and the paint coating absorbs the heat so substantially cure the paint coating.

Referring back to FIG. 1, the workpiece 2 enters the radiation cure station 14 of the exemplary curing process 20 upon exiting the heat flash station 12. Exemplary embodiments envisioned of the radiation cure station 14 include the application of ultraviolet light 34 or NIR light 42 discussed by methods described in FIGS. 5*a* and 5*b*. Alternative forms of radiant light energy contemplated to cure the workpiece include shortwave and medium-wave IR 44 and 46, respectively; however these forms of radiant light energy are less preferred due to increased tack free and cure times. In addition to radiant light energy, alternative forms of energy to cure the workpiece 2 include induction heating (FIG. 5*d*), hydrogen bombardment and electron beams. It should be appreciated that any combination of the above forms of energy may be used in combination to assist in the curing of the workpiece 2.

As discussed above, both ultraviolet and NIR light energy 34 and 42, respectively are limited to curing surfaces of a workpiece 2 that are within the line of sight of the radiant light energy source (i.e., UV lamp 534 or NIR lamp 542) because light travels in a straight line. For example, interior surfaces of an automobile that include door frames or the back side of a trunk lid cannot be cured if the radiant light energy (i.e., ultraviolet light 34 or NIR light 42) is blocked by other panels of the automobile. It is known to mount lamps for projecting ultraviolet light 34 or NIR light 42 on robotic arms or to utilize plasma ultraviolet light 34 chambers to reach interior or hidden surfaces of the workpiece 2. However, these solutions can increase cost and slow down process cycle time for substantially curing the workpiece 2. The exemplary curing process 20 disclosed herein utilizes the radiant cure station 14 to promote cross-linking on a surface of the painted workpiece 2 by projecting radiant light energy (i.e., ultraviolet light 34 or NIR light 42) on exterior surfaces of the workpiece 2, and thus, achieving reduced energy consumption and fast cure times on the exterior surfaces of the workpiece 2. Whereas, the exemplary curing process 20 additionally utilizes the ambient curing station 16 to cure interior surfaces, or surfaces not in the line of sight of the radiant light energy source (i.e., UV lamp 534 or NIR lamp 542), to cure the workpiece 2. It is appreciated that slow tack free times associated with ambient curing are less susceptible to airborne dust collection on interior surfaces of the painted workpiece 2 as opposed to exterior surfaces.

Once exterior surfaces of the workpiece 2 within the line of sight of the radiant light energy source (i.e., NIR lamp 542 or UV lamp 534 shown in FIGS. 5*a* and 5*b*, respectively) are substantially cured at the radiant cure station 14, the workpiece 2 enters the ambient cure station 16. Utilizing ambient air at ambient temperature, the ambient cure station 16 cures surfaces of the workpiece 2 that were not cured at the radiation cure station 14. Curing the workpiece 2 at ambient temperature is advantageous because interior surfaces and other surfaces that were not accessible at the radiation cure station 14 get cured while avoiding the use of expensive equipment (i.e., robotic arms and plasma chambers). In an alternative embodiment, the ambient cure station 16 can blow warm or hot air to help facilitate the curing process and decrease tack free times.

Figure 6:
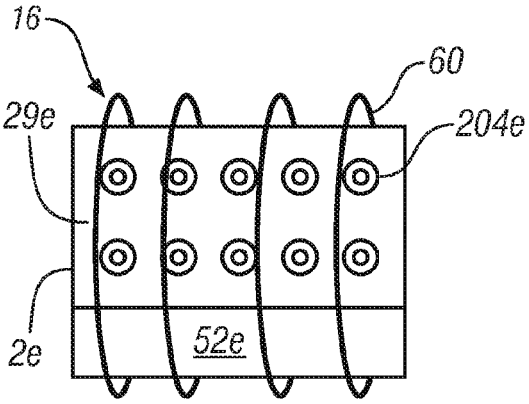

Referring to FIG. 6, a pictorial diagram of the ambient cure station 16 illustrating the chemical reaction during the curing of a workpiece 2*e* utilizing ambient air 60 is shown, in accordance with the present disclosure. Paint coating 29*e* applied to a substrate surface 52*e* of the workpiece 2*e* is cured by cross-linking the plurality of paint molecules 204*e* with the ambient air 60 over a period of time. For example, full cure of the paint coating 29*e* can occur in about 12 to 16 hours utilizing ambient air 60. Tack free time is established at or near 20 to 30 minutes. However, because interior surfaces are not directly exposed to airborne dust, the workpiece 2*e* is not as susceptible to having dirt-in-paint defects. It is appreciated, that the paint coating 29*e* can include the chemical composition of the paint coating 200 (see FIG. 2) capable of being cured or hardened by both efficient radiant light energy (i.e., the radiation cure station 14) and ambient air 60 at the ambient cure station 16.

Referring to FIGS. 1, 5 and 6, it is appreciated that the exemplary curing process 20 in association with the paint coating 200 (see FIG. 2) enables exterior surfaces of a workpiece 2*a*-2*d* to be cured within seconds, and surfaces not easily accessible (i.e., interior surfaces) at the radiant cure station 14 to be cured by ambient air 60 at the ambient cure station 16. Thus, the exemplary curing process 20 eliminates or substantially reduces the collection of airborne dust and dirt-in paint on appearance critical exterior surfaces due to slow tack free time, while the ambient cure system 16 eliminates the need for expensive equipment and additional steps to cure paint on less-appearance critical interior surfaces or other surfaces not within the line of sight of the radiant light energy source (i.e., UV lamp 534 or NIR lamp 542).

Upon exiting the exemplary curing process 20, the substantially cured workpiece 2 enters the inspection station 18. At the inspection station 18, the substantially cured workpiece 2 is inspected for scratches, blemishes and defects in the workpiece 2. If the finish of the workpiece 2 meets industry standards the workpiece 2 exits the paint application process 100. If the finish of the workpiece 2 does not meet industry standards (i.e., defects are found in the finish of the workpiece 2 or workpiece is not substantially cured), the workpiece 2 may be sent back to the coating station 10, the heat flash station 12, the radiation cure station 14 or the ambient cure station 16 to fix any defects found in the finish of the workpiece 2 at the inspection station 18. For example, the finished workpiece 2 can be an automobile where it is determined that portions of the inside door frame were not painted. The unpainted portions of the inside door frame can be touched up and left to cure in the ambient cure station 16 until being substantially cured.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for curing a paint coating applied to a workpiece, comprising:

applying, at a coating station, a paint coating to surfaces of the workpiece, the paint coating capable of being cured by both near infrared radiant light energy and ambient air at ambient temperature and formed from a mixture comprising polymer molecules that provide structural integrity and prevent cracking during the curing, and silica molecules that provide scratch resistance, the silica molecules cross-linked with the polymer segments;

presenting the workpiece to a heat flash station wherein solvents and water are driven out of the paint coating on the workpiece within the heat flash station;

immediately after exiting the heat flash station, presenting the workpiece to a radiation cure station including a near infrared radiant light energy source, wherein a first portion of said surfaces of the workpiece having said paint coating applied thereto is line of site exposed to the near infrared radiant light energy source, and a second portion of said surfaces of the workpiece having said paint coating applied thereto is not line of site exposed to the near infrared radiant light energy source, wherein only the paint coating on the first portion of said surfaces of the workpiece is cured within the radiation cure station by line of sight exposure to said near infrared radiant light energy source, and wherein the paint coating on the second portion of said surfaces of the workpiece is not cured by line of site exposure to said radiant light energy; and subsequent to presenting the workpiece to the radiation cure station, presenting the workpiece to an ambient cure station wherein the paint coating on the second portion of said surfaces of the workpiece is cured within the ambient cure station only using ambient air at ambient temperature.

2. The method of claim 1, wherein said workpiece comprises an automobile.

3. The method of claim 1, wherein said near infrared radiant light energy source is a near infrared lamp.

4. The method of claim 1, wherein said near infrared radiant light energy source comprises a plurality of near infrared lamps, each lamp for curing a portion of said first portion of said surfaces of the workpiece.

5. The method of claim 1, wherein said paint coating on the second portion of said surfaces of the workpiece is tack free in less than 25 minutes from presentation of the workpiece to the ambient cure station.

6. The method of claim 1, wherein said paint coating on the second portion of said surfaces of the workpiece is substantially cured in less than 16 hours from presentation of the workpiece to the ambient cure station.

7. Method for providing a finish to a vehicle body in an automotive assembly paintshop, comprising:

applying, at a coating station, a paint coating on surfaces of said vehicle body, the paint coating capable of being cured by both near infrared radiant light energy and ambient air at ambient temperature and formed from a mixture comprising polymer molecules that provide structural integrity and prevent cracking during the curing, and silica molecules that provide scratch resistance, the silica molecules cross-linked with the polymer segments;

presenting the vehicle body to heat flash station wherein solvents and water are driven out of the paint coating on said vehicle body within the heat flash station; and utilizing a curing process to cure said paint coating on said surfaces of said vehicle body, the curing process comprising:

immediately after exiting the heat flash station, presenting the vehicle body to a radiation cure station including a near infrared light energy source, wherein a first portion of said surfaces of said vehicle body having said paint coating applied thereto is line of site exposed to the near infrared radiant light energy source, and a second portion of said surfaces of said vehicle body having said paint coating applied thereto is not line of site exposed to the near infrared radiant light energy source, wherein only the paint coating on the first portion of said surfaces of said vehicle body is cured within the radiation cure station by line of sight exposure to said near infrared radiant light energy source, and wherein the paint coating on the second portion of said surfaces of said vehicle body is not cured by line of site exposure to said radiant light energy; and subsequent to presenting the vehicle body to the radiation cure station, presenting the vehicle body to an ambient cure station wherein the paint coating on the second portion of said surfaces of said vehicle body is cured within the ambient cure station only using ambient air at ambient temperature.

8. The method of claim 7, wherein said near infrared radiant light energy source is a near infrared lamp.

9. The method of claim 7, wherein said near infrared radiant light energy source comprises a plurality of near infrared lamps, each lamp for curing a portion of said first portion of said surfaces of said vehicle body.

10. The method of claim 7, wherein said paint coating on the second portion of said surfaces of said vehicle body is tack free in less than 25 minutes from presentation of the vehicle body to the ambient cure station.

11. The method of claim 7, wherein said paint coating on the second portion of said surfaces of said vehicle body is substantially cured in less than 16 hours from presentation of the vehicle body to the ambient cure station.

* * * * *